US011891786B2

(12) United States Patent
Lawrence et al.

(10) Patent No.: US 11,891,786 B2
(45) Date of Patent: Feb. 6, 2024

(54) WALL-MOUNTED WATER CLOSET CARRIER ASSEMBLY

(71) Applicant: Zurn Industries, LLC, Milwaukee, WI (US)

(72) Inventors: John Matthew Lawrence, Milwaukee, WI (US); Frank Schaetzke, Milwaukee, WI (US)

(73) Assignee: ZURN INDUSTRIES, LLC, Milwaukee, WI (US)

( * ) Notice: Subject to any disclaimer, the term of this patent is extended or adjusted under 35 U.S.C. 154(b) by 22 days.

(21) Appl. No.: 17/592,491

(22) Filed: Feb. 3, 2022

(65) Prior Publication Data

US 2022/0243445 A1 Aug. 4, 2022

Related U.S. Application Data

(60) Provisional application No. 63/145,372, filed on Feb. 3, 2021.

(51) Int. Cl.
*E03D 11/14* (2006.01)

(52) U.S. Cl.
CPC ..... *E03D 11/143* (2013.01)

(58) Field of Classification Search
CPC ..... E03D 11/143
See application file for complete search history.

(56) References Cited

U.S. PATENT DOCUMENTS 1,471,154 A 10/1923 Graham
1,582,845 A 4/1926 McArthur
2,015,349 A 9/1935 McArthur
2,065,523 A 12/1936 Groeniger
2,666,211 A 1/1954 Schmid
2,702,391 A 2/1955 Schmid
2,795,798 A 6/1957 Boggess et al.
2,810,918 A 10/1957 Baker et al.
RE24,492 E 6/1958 Gordon
2,932,037 A 4/1960 Manas
3,014,222 A 12/1961 Pope
3,054,119 A 9/1962 Manas et al.
(Continued)

FOREIGN PATENT DOCUMENTS

GB 2223042 A 3/1990

OTHER PUBLICATIONS

Zurn Industries, Inc. "Zurn Z-1203-H carrier", specification sheet, Aug. 9, 1994, 1 Page, published in USA.
(Continued)

*Primary Examiner* — Christine J Skubinna
(74) *Attorney, Agent, or Firm* — Husch Blackwell LLP

(57) ABSTRACT

A carrier assembly for supporting a water closet having an outlet. The carrier assembly including a faceplate defining an opening therethrough, where the opening includes a first end configured to form a water-tight seal with the outlet of the water closet and a second end opposite the first end, and a fluid coupler defining a fluid pathway therethrough, where the fluid pathway includes an inlet and an outlet opposite the inlet, where the outlet is configured to be coupled to and form a water-tight seal with a wastewater pipe while the fluid pathway is in fluid communication with an internal volume of the wastewater pipe, and where the outlet has at least one degree of adjustability relative to the wastewater pipe.

20 Claims, 9 Drawing Sheets

(56) References Cited

U.S. PATENT DOCUMENTS

| | | | | |
|---|---|---|---|---|
| 3,098,242 | A | 7/1963 | Ambruster | |
| 3,271,054 | A | 9/1966 | Schmid | |
| 3,271,794 | A | 9/1966 | Flegel | |
| 3,278,950 | A | 10/1966 | Hutchins | |
| 3,286,280 | A | 11/1966 | Duggan | |
| 3,323,143 | A | 6/1967 | Pope | |
| 3,435,467 | A | 4/1969 | Flegel | |
| 3,540,065 | A | 11/1970 | Schmid | |
| 3,686,695 | A * | 8/1972 | Mielback | E03D 11/143 4/252.3 |
| 3,732,582 | A | 5/1973 | Mielback et al. | |
| 3,944,175 | A | 3/1976 | Kearney | |
| 4,058,859 | A | 11/1977 | Arrowood | |
| 4,091,473 | A | 5/1978 | Matthews et al. | |
| 4,108,477 | A | 8/1978 | Morris | |
| 4,482,161 | A | 11/1984 | Izzi, Sr. | |
| 4,979,239 | A | 12/1990 | Klein et al. | |
| 5,205,056 | A | 4/1993 | Okajima et al. | |
| 6,301,838 | B1 | 10/2001 | Hall | |
| 6,889,392 | B1 | 5/2005 | Karnopp et al. | |
| 6,928,669 | B2 | 8/2005 | Akin | |
| 6,979,027 | B2 | 12/2005 | Hetzler et al. | |
| 7,146,655 | B2 | 12/2006 | Karnopp et al. | |
| 8,141,177 | B1 * | 3/2012 | Majocka | E03D 11/14 4/252.2 |
| 8,505,124 | B2 | 8/2013 | Eichler et al. | |
| 8,544,121 | B1 | 10/2013 | Majocka et al. | |
| 9,464,426 | B1 | 10/2016 | Schaetzke et al. | |
| 2004/0133969 | A1 * | 7/2004 | Akin | E03D 11/14 4/252.2 |
| 2005/0012329 | A1 * | 1/2005 | Brown | F16L 27/073 285/272 |
| 2008/0172953 | A1 | 7/2008 | Plorkowski | |
| 2009/0249535 | A1 * | 10/2009 | Eichler | E03D 11/14 4/252.2 |
| 2013/0205494 | A1 | 8/2013 | Whiteside | |

OTHER PUBLICATIONS

Specification Sheet for Z1203-N4-M, "Adjustable Horizontal Siphon Jet No-Hub", Zurn Industries, LLC, Feb. 24, 2011, 1 Page.

Specification Sheet for 21210-45, "Finishing Frame For Siphon Jet System", Zurn Industries, LLC, Nov. 18, 2010, 1 Page.

* cited by examiner

WALL-MOUNTED WATER CLOSET CARRIER ASSEMBLY

RELATED APPLICATIONS

The present application claims priority to U.S. Provisional Patent Application No. 63/145,372, filed Feb. 3, 2021. The contents of which are hereby incorporated by reference.

FIELD OF THE INVENTION

The present application relates to assemblies for mounting a water closet and, more particularly, to support a wall-mounted water closet.

BACKGROUND

Water closets are typically installed using some form of carrier.

SUMMARY

A first embodiment includes a carrier assembly having a faceplate and a fluid coupler. An opening in the fluid coupler is configured to engage a wastewater outlet of a water closet. The opening is aligned with an inlet of the fluid coupler. An outlet of the fluid coupler is configured to direct a fluid flow to a wastewater pipe. The faceplate includes a plurality of mounting apertures configured to mount the faceplate to a wall assembly. Each of the mounting apertures couples the faceplate to a vertical stud. In some embodiments, the faceplate is configured to be mounted to the wall assembly at a height above a bottom plate of the wall assembly such that the faceplate is not supported at a bottom side thereof.

Another embodiment includes a modular wall assembly comprising a top plate, a bottom plate, and a plurality of vertical studs collectively defining an internal wall volume. A carrier assembly configured to support a wall-mounted water closet thereon is coupled only to the vertical studs of the wall assembly. In some embodiments, the carrier assembly is located fully within the internal wall volume. In some embodiments, fasteners extend through the carrier assembly and into the front surface of adjacent vertical studs to couple the carrier assembly to the wall assembly.

Another embodiment includes a method of coupling a carrier assembly to a wall assembly. The method includes coupling a fluid coupler to a wastewater pipe. In some embodiments, coupling a fluid coupler to a wastewater pipe includes fastening a saddle tee of the fluid coupler to the wastewater pipe via an adhesive and boring a hole into the wastewater pipe aligned with an outlet of the fluid coupler. The method further includes aligning vertical slots of a faceplate with threaded openings in the fluid coupler and extending fasteners through the vertical slots and threaded openings to couple the faceplate to the fluid coupler at a desired height of the faceplate. The method further includes fastening the faceplate to vertical studs of the wall assembly.

In another embodiment, a carrier assembly for supporting a water closet having an outlet. The carrier assembly including a faceplate defining an opening therethrough, where the opening includes a first end configured to form a water-tight seal with the outlet of the water closet and a second end opposite the first end, and a fluid coupler defining a fluid pathway therethrough, where the fluid pathway includes an inlet and an outlet opposite the inlet, where the inlet is configured to be coupled to the faceplate to form a water-tight seal therewith while the fluid pathway is in fluid communication with the opening, and where the inlet has at least one degree of adjustability relative to the faceplate. The carrier assembly also includes an outlet configured to be coupled to and form a water-tight seal with a wastewater pipe while the fluid pathway is in fluid communication with an internal volume of the wastewater pipe, and where the outlet has at least one degree of adjustability relative to the wastewater pipe.

In another embodiment, a method of installing a water closet having an outlet to a wall having one or more uprights and a wastewater pipe having an internal volume using a carrier assembly, where the carrier assembly includes a faceplate defining an opening having a first end and a second end opposite the first end, and a fluid coupler defining a fluid passage having an inlet and an outlet opposite the inlet, the method including mounting the water closet to the faceplate so that the outlet of the water closet forms a water-tight seal with the first end of the opening, mounting the fluid coupler to the faceplate so that the inlet of the fluid coupler is in fluid communication with the second end of the opening, adjusting the fluid coupler relative to the faceplate along at least one degree freedom, forming a water-tight seal between the faceplate and the fluid coupler, mounting the fluid coupler to the wastewater pipe so that the outlet of the fluid coupler is in fluid communication with the internal volume of the wastewater pipe, adjusting the fluid coupler relative to the wastewater pipe along at least one degree of freedom, and forming a water-tight seal between the fluid coupler and the wastewater pipe.

In another embodiment, a carrier assembly for supporting a water closet having an outlet, the carrier assembly including a faceplate defining an opening therethrough, where the opening includes a first end configured to form a water-tight seal with the outlet of the water closet and a second end opposite the first end, and a fluid coupler defining a fluid pathway therethrough, where the fluid pathway includes an inlet and an outlet opposite the inlet, where the inlet is configured to be coupled to the faceplate to form a water-tight seal therewith, and an outlet configured to be coupled to and form a water-tight seal with a wastewater pipe, where the outlet is a saddle tee.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
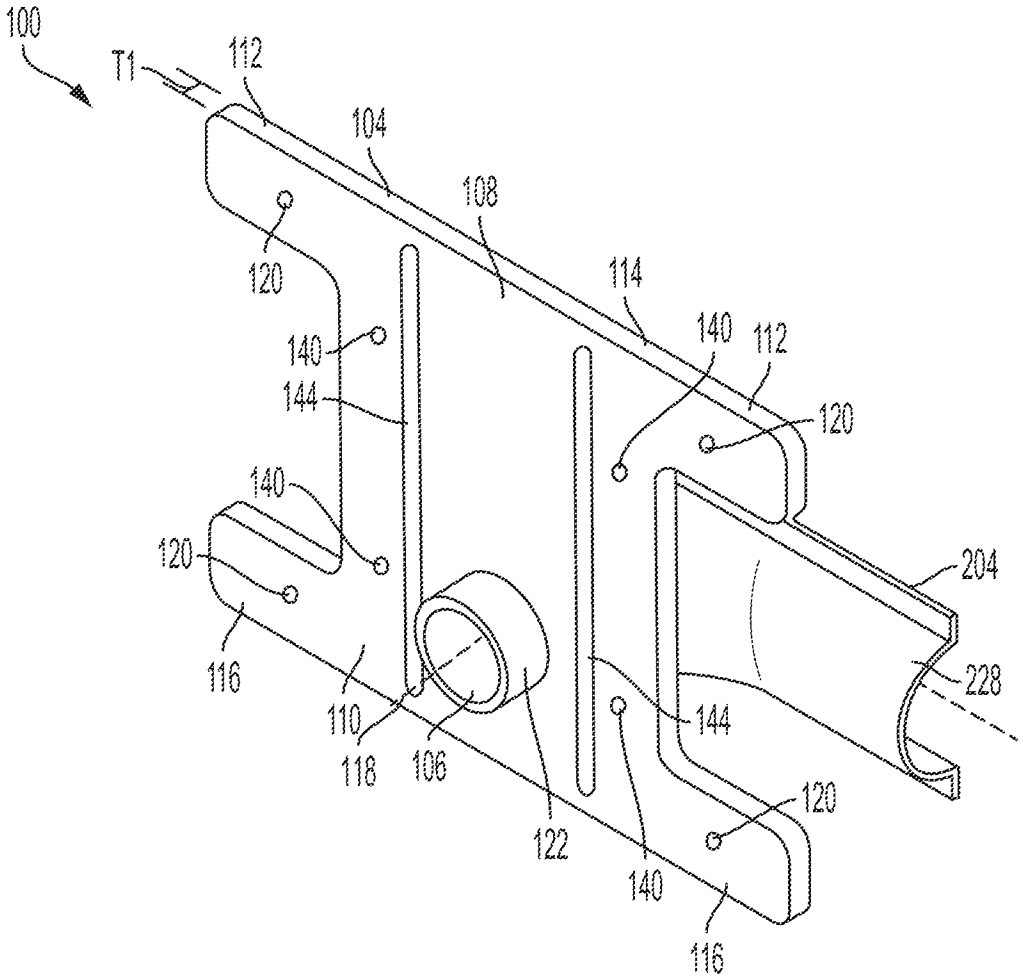
FIG. 1 is a front perspective view of a carrier assembly.
Figure 2:
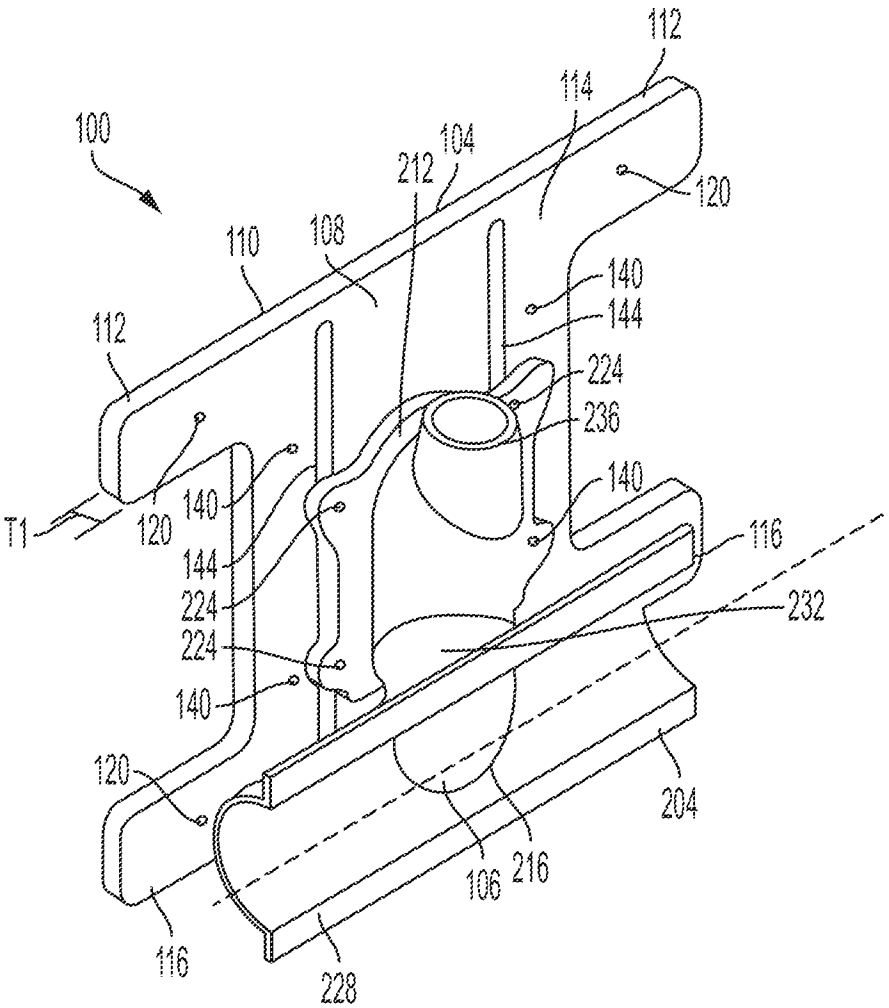
FIG. 2 is a rear perspective view of the carrier assembly of FIG. 1.
Figure 3:
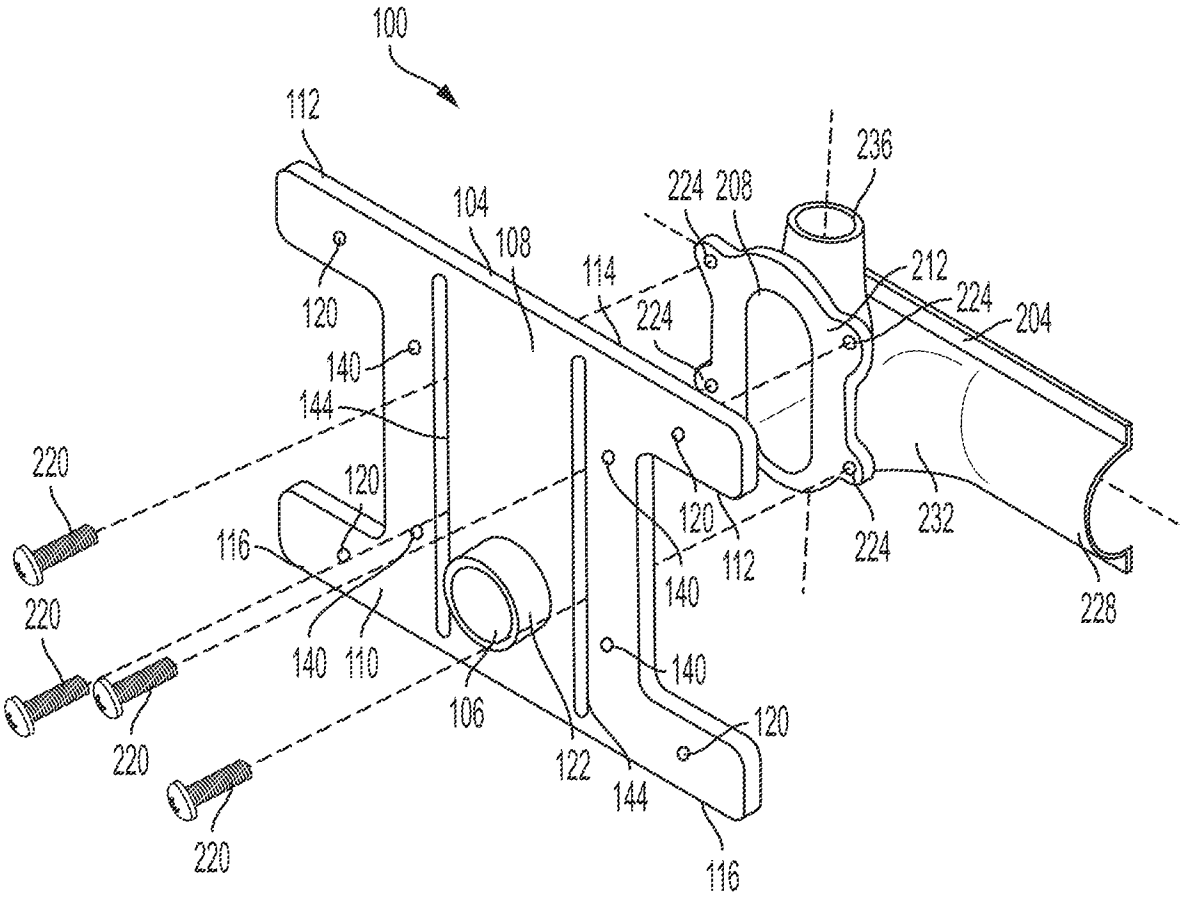
FIG. 3 is an exploded front perspective view of the carrier assembly of FIG. 1.

FIG. 1 illustrates a carrier assembly 100 for supporting a wall-mounted water closet (e.g., a toilet, latrine, or lavatory) in an elevated cantilevered position. More specifically, the carrier assembly 100 is configured to be mounted to a wall assembly 300, described below, whereby the carrier assembly 100 provides a mounting location to which a water closet may be attached. Once attached, the carrier assembly 100 is configured to transmit any loads applied to the water closet (e.g., a person sitting thereon, and the like) into the wall assembly 300 for support. In the illustrated embodiment, the carrier assembly 100 not only provides physical support for the water closet but also serves as a fluid connection point by placing the outlet of the water closet in fluid communication with a corresponding wastewater pipe 308 defining an axis and an internal volume therein.

The carrier assembly 100 shown in FIGS. 1-4 includes a faceplate 104 and a bracket or fluid coupler 204 adjustably coupled to the faceplate 104. The faceplate 104, in turn, has an I-shaped profile including a front or first side 110, and a rear or second side 114 opposite the front side 110. In the illustrated embodiments, the two sides 110, 114, are spaced apart from one another a first distance defining a faceplate thickness T1 therebetween (see FIG. 1).

As shown in FIG. 1, the faceplate 104 includes a central portion 108 flanked by opposing upper arms 112 and lower arms 116. The upper arms 112 extend outward from the central portion 108 adjacent a top side of the central portion 108 and the lower arms 116 extend outward from the central portion 108 adjacent a bottom side of the central portion. Mounting openings 120 herein shown as through-holes extend through each of the upper and lower arms 112, 116 and function as mounting holes for coupling the carrier assembly 100 to a wall stud 304 of the wall assembly 300 (described below). During use, threaded fasteners 124 are driven through the mounting holes 120 into the wall assembly 300 to fixedly couple the carrier assembly 100 to the wall assembly 300.

The through-holes 120 in the opposing upper arms 112 and opposing lower arms 116 are spaced apart from one another by sixteen inches on center to align with spaced studs of the wall assembly 300, though other widths may be used dependent upon stud spacing standards. In some embodiments, the through-holes 120 are elongated slots such that the faceplate 104 can be mounted to the wall assembly 300 at positions offset from a central placement between adjacent studs of the wall assembly 300.

The faceplate 104 also defines an opening or fluid passageway 106 extending through a thickness T1 of the faceplate 104 and open to both the front side 110 and the rear side 114. More specifically, the opening 106 includes a first end open to the front side 110, a second end opposite the first end and open to the rear side 114, and defines an opening axis 118 therethrough. The cylindrical opening 106 is sized and shaped on the front side 110 of the faceplate 104 to align and form a water-tight seal with an outlet of the water closet. Though the faceplate is generally flat (having a substantially uniform thickness T1), the passageway 106 includes a cylindrical boss or protrusion 122 that extends outward from the front side 110. While the illustrated embodiment is shown without a seal, the fluid passageway 106 may include a sealing element (e.g., a wax ring) to help provide a watertight seal between the carrier assembly 100 and the outlet of the water closet.

As shown in FIG. 1, the faceplate 104 also includes a plurality of threaded openings 140 located within the central portion 108 of the faceplate 104 for mounting the water closet to the faceplate 104. In the illustrated embodiment, the faceplate 104 includes four threaded openings 140 spaced apart from one another in a rectangular pattern to align and correspond with a similar pattern at the rear of the water closet. Threaded fasteners (not shown) extend through the rear of the water closet and into engagement with each of the openings 140 to mount the water closet to the carrier assembly 100.

The faceplate 104 additionally includes two elongated slots 144 extending substantially vertically along the height of the faceplate 104. During use, the slots 144 are configured to interface with the flange 212 of the fluid coupler 204 (described below) for coupling the two elements together. In the illustrated embodiment, the slots 144 are configured to allow the fluid coupler 204 to be vertically adjusted relative to the face plate 104. While the illustrated slots 144 are oriented substantially vertically to allow for vertical adjustment between the faceplate 104 and the fluid coupler 204, it is understood that in alternative embodiments the slots 144 may be oriented differently to permit adjustability in another orientation (e.g., horizontally and the like). In still other embodiments, the elongated slots 144 may be replaced with discrete circular openings at various locations to provide multiple, discrete mounting locations.

As shown in FIGS. 2-5, the fluid coupler 204 extends between and is configured to establish fluid communication between the opening 106 of the faceplate 104 and the wastewater pipe 308. More specifically, the fluid coupler 204 defines a fluid pathway 106 that includes an inlet 208 configured to be coupled to and form a water-tight seal with the rear side 114 of the face plate 104, and an outlet 216 configured to be coupled to and form a water-tight seal with the wastewater pipe 308.

During use, the fluid coupler 204 is configured so that it establishes at least one degree of adjustability at the inlet 208 (e.g., with respect to the faceplate 104), and at least one degree of adjustability at the outlet 216 (e.g., with respect to the wastewater pipe 308) while still forming a water-tight connection at both locations. More specifically, the fluid coupler 204 is configured to allow the inlet 208 to be adjusted vertically relative to the faceplate 104 (e.g., perpendicular to the axis 118 of the outlet 106) and configured to allow the outlet 216 to be adjusted axially along the length of the wastewater pipe 308 (e.g., parallel to the axis of the wastewater pipe 308). Once adjusted, the fluid coupler 204 may then be secured to both the faceplate 104 and the wastewater pipe 308 to form the desired fluid-tight seals therebetween.

The inlet 208 of the fluid coupler 204 is at least partially enclosed by a flange 212. The flange 212, in turn, forms a substantially obround shape that is elongated in the vertical direction (e.g., the direction of adjustability). The inlet 208 also defines a plurality (e.g., four) of openings 224 sized to allow a fastener to pass therethrough.

When assembled, fasteners extend through the slots 144 of the faceplate 104 and into engagement with openings 224 (e.g., threaded openings) to couple the faceplate 104 to the fluid coupler 204. By doing so, the fasteners place the flange 212 into contact with the rear side 114 of the faceplate 104 forming a water-tight seal therebetween. The combined use of the elongated slots 144 with the circular openings 224 permits an installer to vary the relative vertical location of the faceplate 104 relative to the fluid coupler 204.

To further facilitate the vertical adjustability between the faceplate 104 and the fluid coupler 204, the obround shape of the inlet 208 permits full alignment of the inlet 208 with the opening 106 in the faceplate 104 at various heights within the mounting range permitted by the elongated slots 144. Stated differently, the inlet 208 and flange 212 enclose a volume that completely encompasses the opening 106 of the faceplate 104 over a range of relative mounting positions therebetween. The resulting alignment between the elements 106, 208 does not substantially decrease the cross-sectional area of the fluid flow path through the carrier assembly as fluid travels through the faceplate 104, into the fluid coupler 204, and to the wastewater pipe 308.

Figure 4:
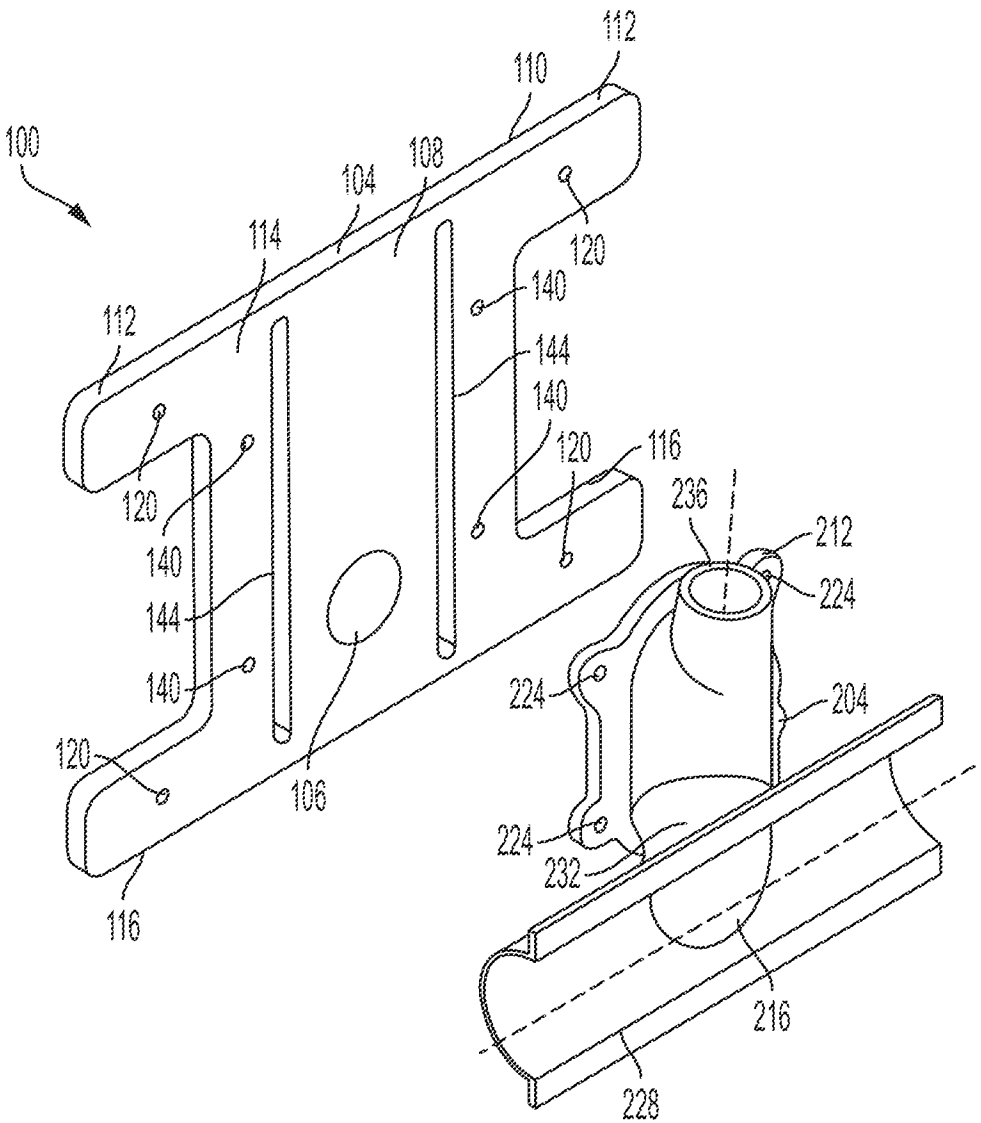
FIG. 4 is an exploded rear perspective view of the carrier assembly of FIG. 1.
Figure 5:
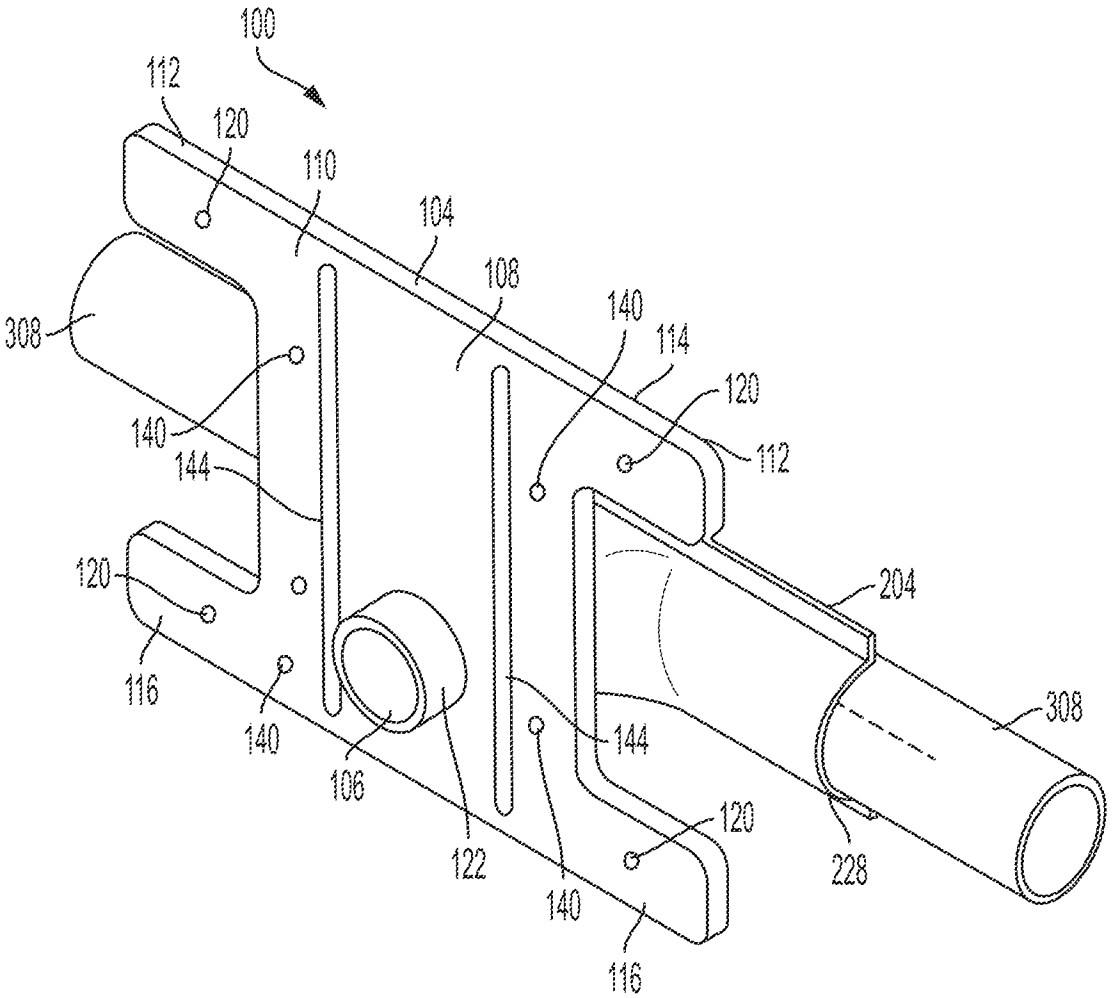
FIG. 5 is a front perspective view of the carrier assembly of FIG. 1 mounted to a wastewater pipe.

As shown in FIG. 4, the outlet 216 of the fluid coupler 204 is configured to be coupled at any one of multiple locations along the length of the wastewater pipe 308 without the use of a separate fitting to form a water-tight connection therebetween. In the illustrated embodiment, the outlet 216 is a saddle tee and includes a first pipe portion 228 extending substantially perpendicular to the inlet 208 and flange 212, with the first pipe portion or mounting member 228 having a semicircular cross-section. The inner radius of the first pipe portion 228 is similar to the outer radius of the wastewater pipe 308 such that the pipe portion can rest snugly against the wastewater pipe 308 and form a water-tight connection therebetween. The first pipe portion 228 is coupled to the flange 212 via a second pipe portion 232, the second pipe portion 232 extending between the inlet 208 at the flange 212 and the outlet 216 at the first pipe portion 228. The second pipe portion 232 follows an arc along its length such that the fluid flow through the second pipe portion 232 flows into the wastewater pipe 308 in a draining direction.

As a saddle tee, the fluid coupler 204 can be coupled to and integrated into an existent, installed wastewater pipe 308 by fastening the fluid coupler 204 to the wastewater pipe 308 (i.e., adhering the first pipe portion 228 to the outside of the wastewater pipe via a plumbing adhesive, using pipe clamps, and the like) and boring a hole into the wastewater pipe 308 that aligns with the outlet 216. By doing so, the outlet 216 of the fluid coupler 204 can be located anywhere along the length of the pre-existing wastewater pipe 308 without the need of a separate fitting. In alternative embodiments, the first pipe portion 228 of the fluid coupler 224 may be fully cylindrical and installed inline between adjacent upstream and downstream wastewater pipes 308 such that the first pipe portion 228 forms a portion of the wastewater pipe 308.

The fluid coupler 204 further includes a vent 236 extending vertically upward from the second pipe portion 232 and in fluid communication with the fluid pathway 106. The vent 236 provides a fluid or air path between other plumbing fixtures via a pipe 328 (FIGS. 8-10) separate from the wastewater pipe 308. More specifically, the pipe 328 generally extends vertically upwardly from the vent 236 and is open to atmospheric pressure.

Wall assemblies 300 include a plurality of studs 304 spaced apart at substantially regular intervals between a bottom plate 312 and a top plate 316. While some uses, such as residential uses, may use wood lumber for the structure 304, 312, 316 of the wall assembly 300, the illustrated embodiment utilizes a metal (e.g., aluminum, steel, etc.) structure. Such a metal structure may be more commonly utilized in a larger industrial or retail atmosphere. Collectively, the studs 304, bottom plate 312, and top plate 316 define an internal wall volume 320 having regularly spaced gaps 324 vertically between the top and bottom plates 116, 112 and laterally between the adjacent studs 304. A finishing surface (e.g., drywall, tile, paneling) is affixed to a front side of the wall assembly located outside of the internal wall volume 320 to cover the plates 112, 116, studs 304, and gaps 324.

Figure 6:
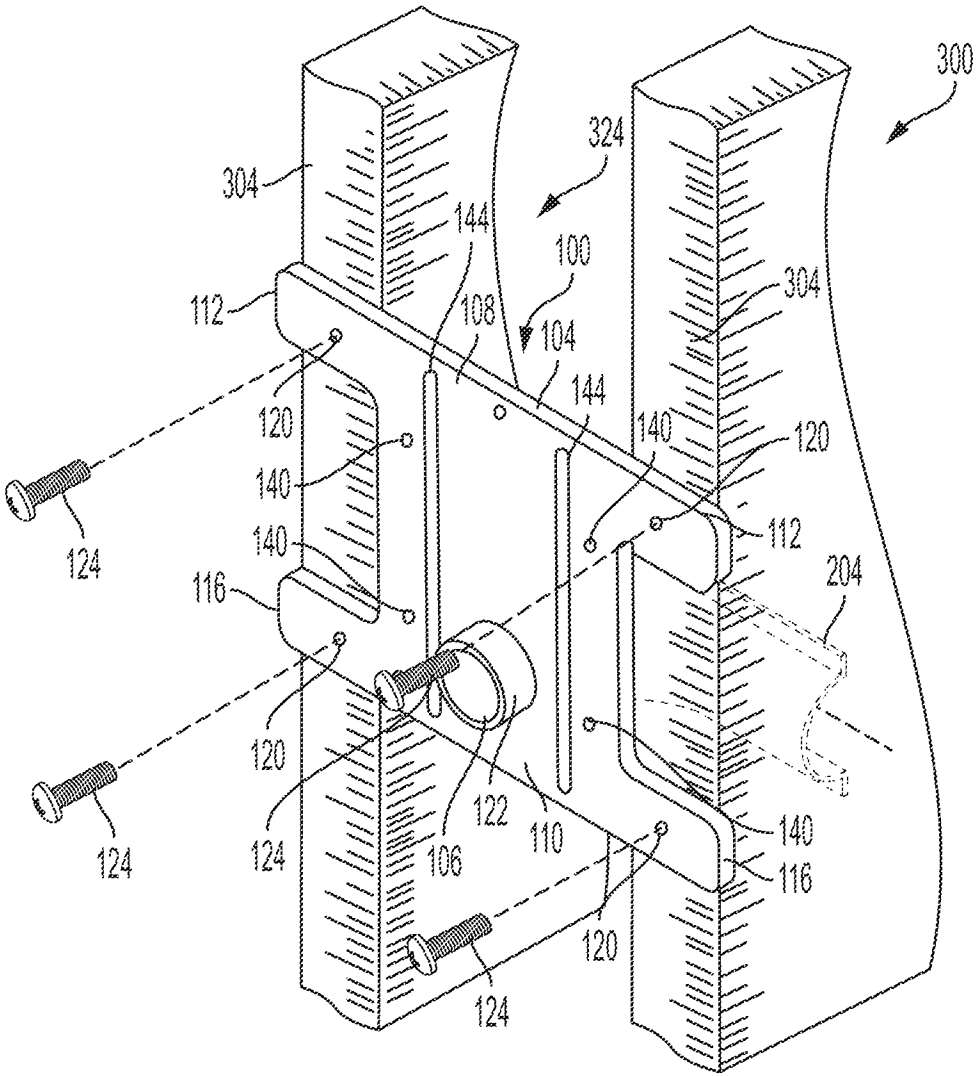
FIG. 6 is a front perspective view of the carrier assembly of FIG. 1 mounted to a wall assembly.
Figure 7C:
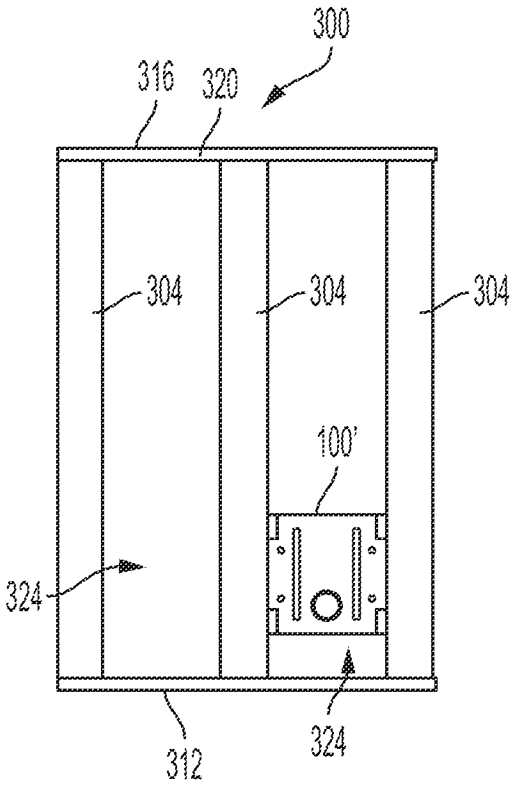
FIGS. 7A-7C are simplified front views of a modular wall assembly with the carrier assembly of FIG. 1 mounted thereon.
Figure 7B:
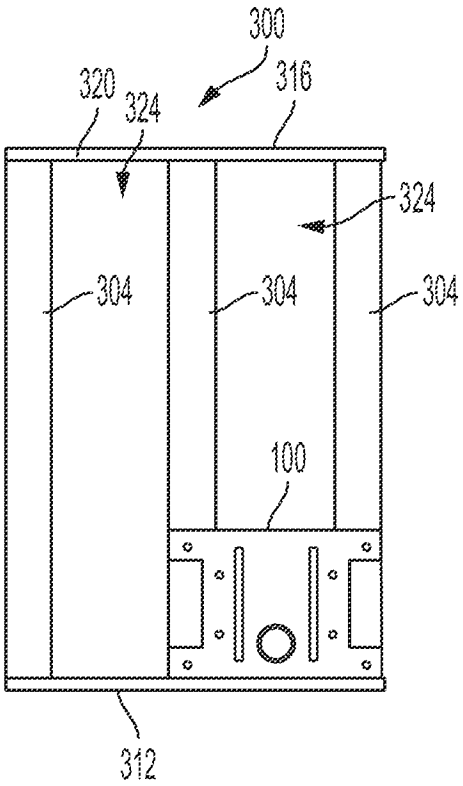
Figure 7A:
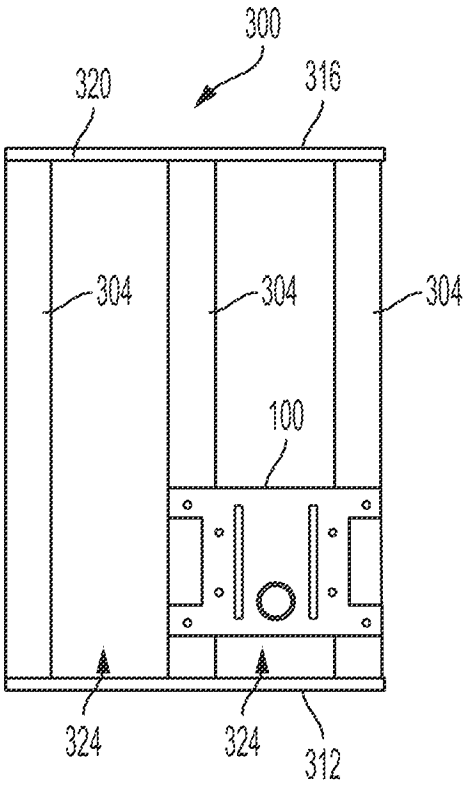
Figure 8:
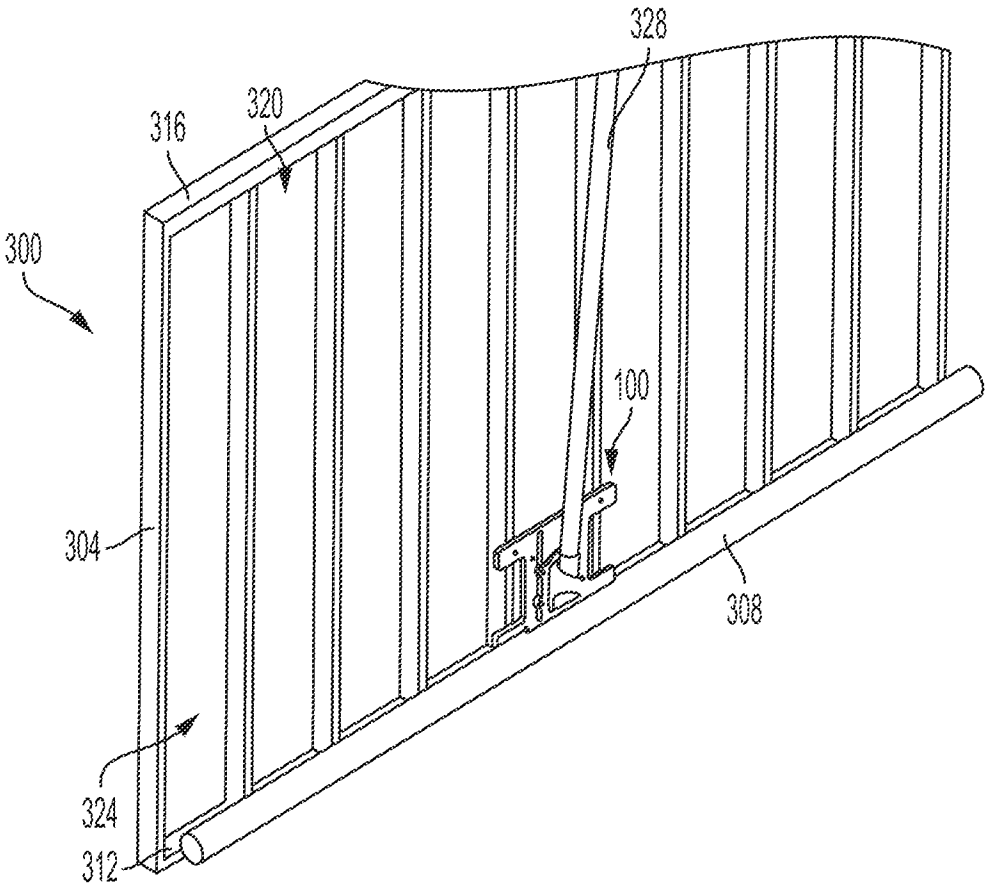
FIG. 8 is a rear perspective view of the carrier assembly of FIG. 1 mounted to a wall assembly.

In some embodiments, such as the embodiment shown in FIGS. 6-8, the wall assembly is a modular, prefabricated wet wall assembly that is fully assembled prior to installation. The bottom plate 312, top plate 316, and studs 304 are assembled together to define the internal wall volume 320 prior to delivery to the final installation location where the wall assembly 300 will function as one of the walls of a bathroom and may function as the wall separating two bathrooms. The wastewater pipe 308 and other pipes (e.g., water supply pipe) and fixtures are additionally preinstalled within the internal wall volume 320 prior to delivery of the complete wall assembly 300 at the installation location. In some embodiments, the carrier assembly 100 is likewise preinstalled within the wall assembly 300 prior to delivery and installation of the modular wall.

The use of prefabricated wall assemblies and metal wall assemblies, such as the wall assembly 300, presents some challenges for mounting a carrier assembly 100 for supporting a water closet. Traditional carrier assemblies mount to a bottom plate via one or more threaded fasteners, though a metal wall assembly may have thinner studs and plates than a comparable lumber frame. Additionally, if the fastener for coupling a carrier assembly to the wall assembly is configured to extend through the bottom plate and into a floor, a prefabricated wall assembly cannot pre-mount the carrier assembly to the bottom plate as the wall assembly is prefabricated at a location other than the final location.

Therefore, the carrier assembly 100 is not fastened to the bottom plate 312 via threaded fasteners, but is instead fastened only to the adjacent studs 304. As shown in FIG. 7A, the carrier assembly 100 is situated at a height above the bottom plate 312. In other embodiments, such as shown in FIG. 7B, a lower surface of the carrier assembly 100 may rest upon the bottom plate 312 without fasteners directly coupling the carrier assembly 100 to the bottom plate 312. The lower surface of the carrier assembly 100 may be sized to provide balance and support, even if not fastened thereto. In some embodiments, the lower surface of the carrier assembly 100 may be otherwise coupled to the bottom plate 312 via non-penetrative fasteners, such as an adhesive.

In some embodiments, as shown in FIGS. 7A and 7B, the carrier assembly 100 is fastened to a front side of the studs 304 of the wall assembly 300, with the threaded fasteners 124 extending through the mounting openings 120 in the upper and lower arms 112, 116. In such embodiments, the faceplate 104 is located outside of the internal wall volume. Alternatively, the studs 304 may include cutouts sized to accept the carrier assembly 100 at a specified height such that when the mounting openings 120 are aligned with the studs, the front of the faceplate 104 is flush with or recessed within the front face of the studs 304 such that the faceplate 104, and carrier assembly 100 as a whole, is located fully within the internal wall volume.

In other embodiments, as shown in FIG. 7C, the upper and lower arms 112, 116 may be bent ninety degrees such that the opposing mounting openings 120 in the upper arms 112 are parallel to one another and the opposing mounting openings 120 in the lower arms 116 are likewise parallel to one another. Additionally, the faceplate 104 is narrower to fit between adjacent studs 304. The fasteners 124 therefore extend through the mounting openings 120 to engage an internal surface of the studs 304.

Figure 10:
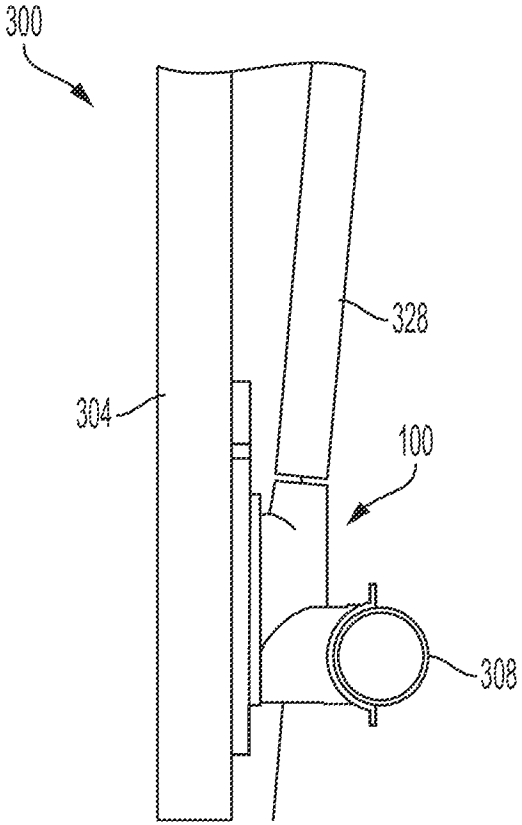
FIG. 10 is a side view of the carrier assembly and the wall assembly of FIG. 8.
Figure 9:
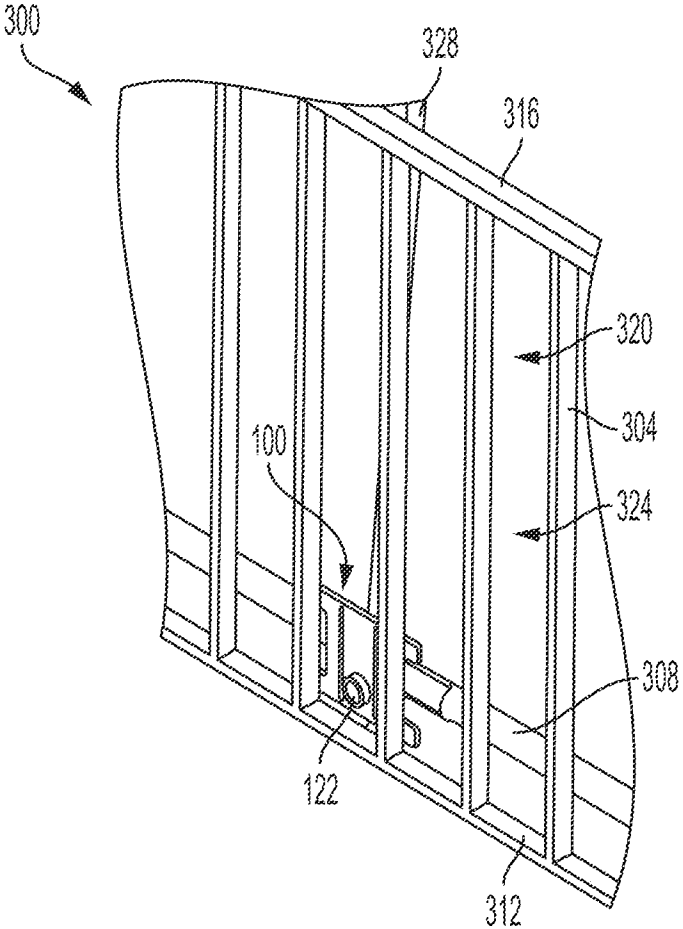
FIG. 9 is a front perspective view of the carrier assembly and the wall assembly of FIG. 8.

In yet other embodiments, as shown in FIGS. 8-10, the carrier assembly 100 is mounted to a rear side of the wall studs 304 such that the cylindrical protrusion 122 is the only portion of the carrier assembly 100 that extends into the internal wall volume 320, with the remainder of the carrier assembly 100 being positioned behind the wall assembly 300. Such an arrangement may be provided in environments where spacing is provided behind wall assemblies to facilitate large plumbing arrangements or full technician access.

The protrusion 122 may have an extended length to pass through the internal wall volume and engage the mating outlet of the water closet. Alternatively, an insert (not shown) may be mounted between the protrusion 122 and the outlet of the water closet to complete the connection.

The invention claimed is:

1. A wall-mounted carrier assembly for supporting a water closet having an outlet, the carrier assembly comprising:

a faceplate including:

an opening extending through the faceplate, wherein the opening includes a first end configured to form a water-tight seal with the outlet of the water closet and a second end opposite the first end;

a first mounting hole; and a second mounting hole;

a fluid coupler defining a fluid pathway therethrough, wherein the fluid pathway includes an inlet and an outlet opposite the inlet, wherein the inlet is configured to be coupled to the faceplate to form a water-tight seal therewith while the fluid pathway is in fluid communication with the opening, wherein the inlet has at least one degree of adjustability relative to the faceplate, wherein the outlet is configured to be coupled to and form a water-tight seal with a wastewater pipe while the fluid pathway is in fluid communication with an internal volume of the wastewater pipe, and wherein the outlet has at least one degree of adjustability relative to the wastewater pipe;

a first fastening member extending through the first mounting hole and engaging a first wall stud to directly support the faceplate on the first wall stud in a position spaced apart from a floor surface;

a second fastening member extending through the second mounting hole and engaging a second wall stud to directly support the faceplate on the second wall stud in a position spaced apart from the floor surface, wherein the faceplate is supported solely by the first and second wall studs.

2. The carrier assembly of claim 1, wherein the outlet includes a mounting member, and wherein the mounting member is semi-circular cross-sectional shape.

3. The carrier assembly of claim 1, wherein the outlet includes a saddle tee.

4. The carrier assembly of claim 1, wherein the faceplate and the fluid coupler together form a continuous fluid path that extends from the first end of the opening to the outlet of the fluid coupler.

5. The carrier assembly of claim 1, wherein the fluid coupler includes a vent in fluid communication with fluid pathway.

6. The carrier assembly of claim 1, wherein the inlet of the fluid coupler has an obround shape.

7. The carrier assembly of claim 1, wherein the faceplate includes at least two parallel slots, and wherein the fluid coupled is coupled to the faceplate via the at least two parallel slots.

8. The carrier assembly of claim 1, wherein the opening defines a first axis, and wherein the inlet is adjustable relative to the faceplate in a direction perpendicular to the first axis.

9. The carrier assembly of claim 8, wherein the wastepipe defines a second axis, and wherein the outlet is adjustable relative to the wastepipe in a direction parallel to the axis.

10. The carrier assembly of claim 1, wherein the wastepipe defines an axis, and wherein the outlet is adjustable relative to the wastepipe in a direction parallel to the axis.

11. The carrier assembly of claim 1, wherein the outlet is configured to be coupled to the wastepipe using a plumbing adhesive.

12. A method of installing a water closet having an outlet to a wall having one or more uprights and a wastewater pipe having an internal volume using a wall-mounted carrier assembly, wherein the carrier assembly includes a faceplate defining an opening having a first end and a second end opposite the first end, and a fluid coupler defining a fluid passage having an inlet and an outlet opposite the inlet, the method comprising:

mounting the faceplate to at least one of the uprights such that the faceplate is supported solely by the wall uprights;

mounting the water closet to the faceplate so that the outlet of the water closet forms a water-tight seal with the first end of the opening;

mounting the fluid coupler to the faceplate so that the inlet of the fluid coupler is in fluid communication with the second end of the opening;

adjusting the fluid coupler relative to the faceplate along at least one degree freedom;

forming a water-tight seal between the faceplate and the fluid coupler;

mounting the fluid coupler to the wastewater pipe so that the outlet of the fluid coupler is in fluid communication with the internal volume of the wastewater pipe;

adjusting the fluid coupler relative to the wastewater pipe along at least one degree of freedom; and forming a water-tight seal between the fluid coupler and the wastewater pipe.

13. The method of claim 12, further comprising forming an aperture in the wastewater pipe.

14. The method of claim 12, further comprising applying plumbing adhesive between the outlet of the fluid coupler and the wastewater pipe.

15. The method of claim 12, wherein the opening defines a first axis, and wherein adjusting the fluid coupler relative to the faceplate includes adjusting the fluid coupler in a direction perpendicular to the first axis.

16. The method of claim 15, wherein the wastewater pipe defines a second axis, and wherein adjusting the fluid coupler relative to the wastewater pipe includes adjusting the fluid coupler in a direction parallel to the second axis.

17. The method of claim 12, wherein the wastewater pipe defines an axis, and wherein adjusting the fluid coupler relative to the wastewater pipe includes adjusting the fluid coupler in a direction parallel to the axis.

18. A wall-mounted carrier assembly for supporting a water closet having an outlet, the carrier assembly comprising:

a faceplate including:

an opening extending through the faceplate, wherein the opening includes a first end configured to form a water-tight seal with the outlet of the water closet and a second end opposite the first end;

a first mounting hole; and a second mounting hole;

a fluid coupler defining a fluid pathway therethrough, wherein the fluid pathway includes an inlet and an outlet opposite the inlet, wherein the inlet is configured to be coupled to the faceplate to form a water-tight seal therewith, wherein the outlet is configured to be coupled to and form a water-tight seal with a waste-water pipe;

a first fastening member extending through the first mounting hole and engaging a first wall stud to directly support the faceplate on the first wall stud in a position spaced apart from a floor surface;

a second fastening member extending through the second mounting hole and engaging a second wall stud to directly support the faceplate on the second wall stud in a position spaced apart from the floor surface, wherein the faceplate is supported solely by the first and second wall studs.

19. The carrier assembly of claim 18, wherein the outlet includes a saddle tee.

20. The carrier assembly of claim 1, wherein the first mounting hole is positioned on a first arm and the second mounting hole is positioned on a second arm, the first arm and the second arm oriented perpendicularly relative to a central portion of the faceplate.

* * * * *